United States Patent [19]

Aoyagi et al.

[11] Patent Number: 4,489,336

[45] Date of Patent: Dec. 18, 1984

[54] PRESSURE SENSITIVE MANIFOLD PAPER

[75] Inventors: Shoji Aoyagi; Tetsuo Shiraishi, both of Amagasaki, Japan

[73] Assignee: Kanzaki Paper Manufacturing Co., Ltd., Tokyo, Japan

[21] Appl. No.: 380,393

[22] Filed: May 20, 1982

[30] Foreign Application Priority Data

Jun. 5, 1981 [JP] Japan ..... 56-87042
Jun. 19, 1981 [JP] Japan ..... 56-95793

[51] Int. Cl.[3] ..... B41M 5/22

[52] U.S. Cl. ..... 346/209; 346/213; 346/218

[58] Field of Search ..... 282/27.5; 427/150, 151; 428/411, 537, 914, 320.4, 320.6, 320.8, 913

[56] References Cited

FOREIGN PATENT DOCUMENTS 2017730A 10/1979 United Kingdom ..... 282/27.5
2040303A 10/1980 United Kingdom ..... 346/218

*Primary Examiner*—Bruce H. Hess
*Attorney, Agent, or Firm*—Armstrong, Nikaido, Marmelstein & Kubovcik

[57] ABSTRACT

A pressure sensitive manifold paper is prepared with use of microcapsules having enclosed therein an organic solvent, a color former contained in the solvent, and an alkylphenol compound and/or a mercaptan added to the solvent. The paper affords prints resistant to light and has a color forming layer which remains free of coloration and gives prints of original color even when exposed to light.

14 Claims, No Drawings

PRESSURE SENSITIVE MANIFOLD PAPER

This invention relates to pressure sensitive manifold paper, and more particularly to pressure sensitive manifold paper which is free of coloration or which gives prints free of discoloration even when exposed to sunlight and fluorescent lamp.

Pressure sensitive manifold papers generally include three kinds of sheets, namely top sheets, middle sheets and bottom sheets. The top sheet comprises a substrate coated on one surface thereof with an encapsulated composition consisting essentially of an electron donating organic chromogenic material (hereinafter referred to as "color former") dissolved in an oily material. The middle sheet is prepared by coating one surface of a substrate with a composition consisting chiefly of an electron accepting reactant material (hereinafter referred to as "color acceptor") which produces a color upon coming into contact with the color former and coating the other surface of the substrate with the encapsulated color former composition. The bottom sheet comprises a substrate and a color acceptor coating on one surface thereof. The top sheet and the bottom sheet, or the top sheet, the middle sheet and the bottom sheet are used in combination for copying. Another type of pressure sensitive manifold paper is well known which is termed "self-contained system" wherein a substrate coated with a color former composition and a color acceptor composition on one surface serves singly as a copy sheet.

The color formers heretofore known for use in such pressure sensitive manifold papers are various and include triarylmethane compounds, diphenylmethane compounds, xanthane compounds, thiazine compounds, spiropyran compounds, etc. However, color images formed by the reaction of these color formers with color acceptors are generally prone to reduction in color density or to color change when exposed to sunlight and fluorescent lamp and are therefore low in resistance to light. Above all, xanthene compounds are very low in light resistance. For example, fluoran dyes are disclosed in U.S. Pat. No. 3,501,331 for use as chief color formers for giving black or green images on reaction with a color acceptor, but the prints obtained are very low in resistance to light and therefore change to a red color. Moreover, the fluoran dye-containing color former layer itself becomes colored red when exposed to sunlight or the like. (This color change will hereinafter be referred to as "CB (Coating Back) coloration".) Further, if the color former layer is used for copying after exposure to sunlight or the like, the print (hereinafter referred to as "exposed CB print") bears only a red color.

The main object of the present invention is to provide a pressure sensitive manifold paper which is outstanding in the resistance of prints to light, does not involve CB coloration and free of color change in the case of exposed CB prints even when the color former incorporated therein is a xanthene compound, especially a fluoran dye which is extremely low in light resistance.

The above and other objects of the invention will become apparent from the following description.

The present invention provides a pressure sensitive manifold paper having incorporated therein microcapsules enclosing a nonvolatile organic solvent and a color former contained in the solvent, the paper being characterized in that the organic solvent contains an alkylphenol compound and/or a mercaptan in the form of a solid at room temperature or having a boiling point of at least 150° C. in an amount of 0.2 to 10 parts by weight per 100 parts by weight of the organic solvent.

The alkylphenol compounds to be used in this invention are phenols having an alkyl, cycloalkyl, alkylene or hydroxyl substituent at least at one of the 2- and 6-positions, and derivatives thereof. Examples of useful phenol compounds are as follows.

Monophenols represented by the formula

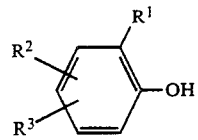

(1)

wherein $R^1$ is $C_{1-5}$ alkyl, $C_{5-7}$ cycloalkyl, hydroxyl or $(R^4)_2NR^5$— in which $R^4$ is hydrogen or $C_{1-5}$ alkyl, and $R^5$ is $C_{1-3}$ alkylene, and $R^2$ and $R^3$ are each hydrogen, $C_{1-5}$ alkyl, $C_{5-7}$ cycloalkyl, $C_{1-3}$ hydroxyalkyl, $C_{1-3}$ alkoxyl, hydroxyl or $(R^4)_2NR^5$— in which $R^4$ and $R^5$ are as defined above.

Diphenols represented by the formula

P—A—P (2)

wherein A is $—(CH_2)_a—$,

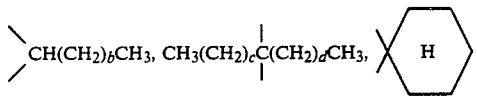

or —S— in which a is 0 or 1, b is 0 or an integer of 1 to 5, and c and d are each 0 or an integer of 1 or 2, and P is

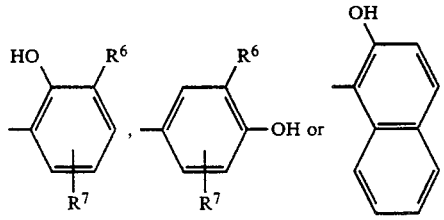

in which $R^6$ is $C_{1-5}$ alkyl, $C_{5-7}$ cycloalkyl, hydroxyl or $(R^4)_2NR^5$—, and $R^7$ is hydrogen, $C_{1-5}$ alkyl, $C_{5-7}$ cycloalkyl, $C_{1-3}$ alkoxyl, hydroxyl or $(R^4)_2NR^5$—, $R^4$ and $R^5$ being as defined above.

Triphenols represented by the formula

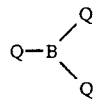

(3)

wherein B is

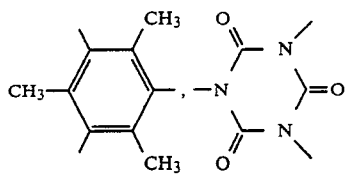

or trivalent $C_{1-5}$ aliphatic hydrocarbon residue, and Q is

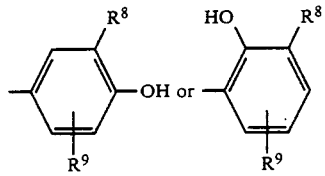

in which $R^8$ is $C_{1-5}$ alkyl and $R^9$ is hydrogen, $C_{1-5}$ alkyl or hydroxyl.

Examples of other alkylphenols include octadecyl-3-(3,5-di-tert-butyl-4-hydroxyphenyl)propionate, 6-(3,5-di-tert-butyl-4-hydroxyanilino)-2,4-bis(n-octylthio)-1,3,5-triazine, (3,5-di-tert-butyl-4-hydroxybenzyl)ethyl phosphate, (3,5-di-tert-butyl-4-hydroxybenzyl)octadecyl phosphate, tetrakis-[methylene-3-(3',5'-di-tert-butyl-4'-hydroxyphenyl)propionate]methane, 2,2'-thiodiethylbis[3-(3',5'-di-tert-butyl-4'-hydroxyphenyl)propionate], N,N'-hexamethylenebis(3,5-di-tert-butyl-4-hydroxyhydrocinnamamide) and 1,6-hexanediolbis-3-(3',5'-di-tert-butyl-4'-hydroxyphenyl)propionate.

The cycloalkyl group in the foregoing definition of $R^1$ to $R^3$, $R^6$ and $R^7$ may have a substituent or no substituent. The compounds of the formula (2) wherein P is naphthol are not phenol compounds in a strict sense, but the invention includes such compounds. Alkylphenols of the invention can be used singly or in admixture with one another.

Representative monophenols of the formula (1) are, for example, 2,6-dimethylphenol, 2,6-di-tert-butylphenol, 2,6-di-tert-butyl-4-methylphenol, 2-tert-butyl-4-methylphenol, 6-tert-butyl-3-methylphenol, 2,4-di-tert-butylphenol, 2,5-di-tert-butyl-4-methylphenol, 2,6-di-tert-butyl-4-hydroxymethylphenol, 2,4,6-tri-tert-butylphenol, 2,4-dimethyl-6-(2'-methylcyclohexyl)phenol, 2,4,6-tri-dimethylaminomethylphenol, 2-tert-butyl-4-methoxyphenol, 2,6-di-tert-butyl-4-ethylphenol, 6-tert-butyl-2,4-dimethylphenol, catechol, 4-tert-butylcatechol, 4,6-di-tert-butylresorcin, 2-tert-butylhydroquinone, 2,6-di-tert-butylhydroquinone and 2,6-di-tert-amylhydroquinone.

Useful diphenols of the formula (2) include 2,2'-methylenebis(6-tert-butyl-4-methylphenol), 2,2'-methylenebis(6-tert-butyl-4-ethylphenol), 2,2'-methylenebis(4,6-di-tert-butylphenol), 4,4'-methylenebis(6-tert-butyl-3-methylphenol), 4,4'-methylenebis(2,6-di-tert-butylphenol), 4,4'-methylenebis(6-tert-butyl-2-methylphenol), 4,4'-butylidenebis(6-tert-butyl-3-methylphenol), 4,4'-propylidenebis(2,6-di-tert-butylphenol), 4,4'-isopropylidenebis(2,6-di-tert-butylphenol), 4,4'-cyclohexylidenebis(2,6-di-tert-butylphenol), 4,4'-bis(2,6-di-tert-butylphenol), 4,4'-bis(2-tert-butylphenol), 2,2'-methylenebis[4-methyl-6-(α-methylcyclohexyl)phenol], 4,4'-thiobis(6-tert-butyl-3-methylphenol), 4,4'-thiobis(2,6-di-tert-butylphenol), 4,4'-thiobis(6-tert-butyl-2-methylphenol), 2,2'-thiobis(6-tert-butyl-4-methylphenol), 2,2'-thiobis(4,6-di-tert-butylphenol), 2,2'-thiobis(4,6-di-tert-butylresorcin) and 1,1'-thiobis(2-naphthol).

Exemplary triphenols of the formula (3) are 1,3,5-trimethyl-2,4,6-tris(3,5-di-tert-butyl-4-hydroxybenzyl)-benzene, 1,1,3-tris(5-tert-butyl-4-hydroxy-2-methylphenyl)butane and 1,3,5-tris(3,5-di-tert-butyl-4-hydroxybenzyl)isocyanurate.

Among these alkylphenol compounds, especially preferable are 2,6-di-tert-butyl-4-methylphenol, 4-tert-butylcatechol, 2,2'-methylenebis(6-tert-butyl-4-methylphenol), 2,2'-methylenebis(6-tert-butyl-4-ethylphenol), 4,4'-butylidenebis(6-tert-butyl-3-methylphenol) and 4,4'-thiobis(6-tert-butyl-3-methylphenol), because these compounds are effective even when used in small amounts and therefore do not impair the stability of the encapsulated oily material, assuring the three effects of improved light resistance of prints, inhibition of CB coloration and prevention of color change of exposed CB prints in well-balanced relation.

The mercaptans to be used in this invention are alkyl monomercaptans, alkyl dimercaptans, aromatic monomercaptans, aromatic dimercaptans and like mercaptans, and derivatives of these mercaptans. While various compounds are known as such mercaptans, mercaptans which are solid at room temperature or have a boiling point of at least 150° C. are selected for use in this invention so as to be incorporated in the organic solvent for preparing microcapsules. It is noted that for the preparation of microcapsules, the color former, etc. are dissolved in an organic solvent usually at a high temperature of 80° to 120° C. The encapsulated color former composition is then applied to a substrate and thereafter dried at a high temperature. If a mercaptan boiling below 150° C. is incorporated into the organic solvent, the low-boiling mercaptan will vaporize during the encapsulating step or coating step, causing pollution to the work environment, entraining the color former when vaporizing off the microcapsules to result in reduced color forming ability and further releasing a noxious odor when the resulting manifold paper is used. To avoid these objections, the present invention uses mercaptans which are solid at room temperature or have a boiling point of at least 150° C.

Examples of preferable alkyl monomercaptans and alkyl dimercaptans of the invention are compounds of the formula $$R^{10}\text{-}(SH)_e \qquad (4)$$

wherein $R^{10}$ is $C_{10-18}$ alkyl or $C_{10-18}$ alkylene, e is 1 or 2. Examples of specific compounds are, for example, n-decyl mercaptan, tert-decyl mercaptan, n-dodecyl mercaptan, tert-dodecyl mercaptan, n-hexadecyl mercaptan, tert-hexadecyl mercaptan, 1,10-decanedithiol and 1,16-hexadecanedithiol.

Examples of preferable aromatic monomercaptans and aromatic dimercaptans are compounds of the formulae

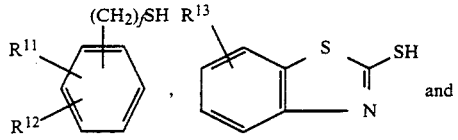

(5) (6)

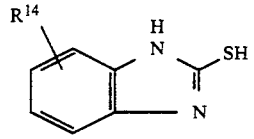

(7)

wherein $R^{11}$ and $R^{12}$ are the same or different and are each hydrogen, mercapto or $C_{1-18}$ alkyl, f is 0 or 1, $R^{13}$ and $R^{14}$ are each hydrogen or $C_{1-3}$ alkyl. Examples of representative compounds are, for example, toluenethiol, benzyl mercaptan, dodecyl-benzyl mercaptan, 4-tert-butylthiophenol, 4-tert-butyl-o-thiocresol, toluene-3,4-dithiol, dithiocatechol, dithioresorcin, dithiohydroquinone, 2-mercaptobenzothiazole, 2-mercaptotoluthiazole, 2-mercaptobenzimidazole and 2-mercaptotoluimidazole. Among these mercaptan compounds, especially preferable are n-dodecyl mercaptan, tert-dodecyl mercaptan, 4-tert-butylthiophenol, toluene-3,4-dithiol, dithiohydroquinone and 2-mercaptobenzothiazole. Mercaptans of the invention can be used singly or in admixture with one another.

According to the invention, the alkylphenol compound and the mercaptan are incorporated into the organic solvent usually in an amount of 0.2 to 10 parts by weight, preferably 0.5 to 6 parts by weight, per 100 parts by weight of the solvent. Use of excesses of these compounds is economically disadvantageous, reduces the stability of the encapsulated oily material and is therefore undesirable.

We have further found that when the organic solvent containing a color former has incorporated therein at least one of the compounds represented by the formula (8) or (9) below as a second component in addition to the alkylphenol compound or mercaptan, the three effects of improved light resistance contemplated by the invention can be enhanced.

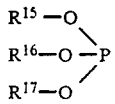

(8)

wherein $R^{15}$, $R^{16}$ and $R^{17}$ are each $C_{4-20}$ alkyl, phenyl or $C_{7-20}$ alkylphenyl.

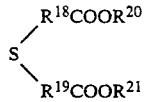

(9)

wherein $R^{18}$ and $R^{19}$ are each $C_{1-6}$ alkylene, and $R^{20}$ and $R^{21}$ are each $C_{8-22}$ alkyl.

Examples of preferable phosphorous acid triesters of the invention represented by the formula (8) are tris(nonylphenyl)phosphite, di(nonylphenyl)-(dinonylphenyl)phosphite, diphenyl-isooctylphosphite, diphenyl-isodecylphosphite, triisooctylphosphite and triisodecylphosphite. Among these phosphorous acid triesters, especially preferable are tris(nonylphenyl)-phosphite and diphenyl-isodecylphosphite.

Examples of useful dialkyl ester derivatives of thioethers of the invention represented by the formula (9) are dilauryl thiodipropionate, dimyristyl thiodipropionate, dicetyl thiodipropionate, ditridecyl thiodipropionate, lauryl stearyl thiodipropionate, distearyl-$\beta,\beta'$-thiodibutyrate, 3-carbolauryloxyethyl-4'-carbolauryloxypropyl thioether and 4-carbostearyloxypropyl-5'-carbolauryloxybutyl thioether. Among these thioether compounds, particularly preferable are dilauryl thiodipropionate, dimyristyl thiodipropionate, dicetyl thiodipropionate and distearyl-$\beta,\beta'$-thiodibutyrate.

According to the invention, at least one of the phosphorous acid triester compounds and the thioether compounds is used in combination with the alkylphenol compound or mercaptan. For example, both the compounds of the formulae (8) and (9) are usable conjointly, or two or more of the compounds of each kind are usable conjointly.

The amount of the second component to be used, which is dependent on the kind of the alkylphenol compound or mercaptan serving as the first component, is preferably 0.2 to 8 parts by weight per 100 parts by weight of the organic solvent.

We have further found that the effects of improving the light resistance contemplated by the present invention can be enhanced to a greater extent by incorporating at least one of other compounds into the organic solvent as a third component, conjointly with the alkylphenol compound or mercaptan and the second component, namely the phosphorous acid triester or thioether derivative. Examples of compounds useful as the third component are p-benzoquinone, $\alpha$-naphthoquinone, $\beta$-naphthoquinone, anthraquinone and like quinones, and nickel dibutyldithiocarbamate, $\alpha$-tocopherol, 1,1-diphenyl-2-picrylhydrazyl and like compounds. Of these third component compounds, quinones and nickel dibutyldithiocarbamate are especially effective. The third component is used preferably in an amount of 0.1 to 3 parts by weight per 100 parts by weight of the organic solvent.

The dyes to be used as color formers in this invention are not particularly limited. Examples of useful dyes are:

Triarylmethane-based dyes, e.g., 3,3-bis(p-dimethylaminophenyl)-6-dimethylaminophthalide (hereinafter referred to as "crystal violet lactone"), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide and 3-p-dimethylaminophenyl-3-(1-methylpyrrole-2-yl)-6-dimethylaminophthalide;

Diphenylmethane-based dyes, e.g., 4,4'-bisdimethylaminobenzhydryl benzyl ether, N-halophenylleucoauramine and N-2,4,5-trichlorophenyl-leucoauramine;

Xanthene-based dyes, e.g., rhodamine-B-anilinolactam, rhodamine-B-(p-nitroanilino)lactam, rhodamine-B-(o-chloroanilino)lactam, 7-dimethylamino-2-methoxyfluoran, 7-dimethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,3-dimethylfluoran, 7-diethylamino-(3-acetylmethylamino)fluoran, 7-diethylamino-(3-methylamino)fluoran, 3,7-diethylaminofluoran, 7-diethylamino-3-(dibenzylamino)fluoran, 7-diethylamino-3-(methylbenzylamino)fluoran, 7-diethylamino-3-(chloroethylmethylamino)fluoran, 7-diethylamino-3-(diethylamino)fluoran, 2-(N-methylanilino)-6-(N-ethyl-p-toluidino)fluoran, 2-methyl-6-(N-ethyl-p-toluidino)fluoran, 3-diethylaminobenz(C)fluoran, 2-mesidino-8-diethylaminobenz(C)fluoran, 3-(N,N-diethylamino)-5-methyl-7-(N,N-dibenzylamino)fluoran, 3-chloro-6-cyclohexylaminofluoran, 3-diethylamino-7-cyclohexylaminofluoran, 3-diethylamino-7-(N-cyclohexyl-N-benzylamino)fluoran, 2-anilino-3-methyl-6-(N-ethyl-p-toluidino)fluoran, 2-p-toluidino-3-methyl-6-(N-ethyl-p-toluidino)fluoran and 3-(N-cyclohexyl-N-methylamino)-6-methyl-7-anilinofluoran;

Thiazine-based dyes, e.g., benzoyl-leucomethyleneblue and p-nitrobenzoyl-leucomethyleneblue;

Spiro-based dyes, e.g., 3-methyl-spiro-dinaphthopyran, 3-ethyl-spiro-dinaphthopyran, 3-phenyl-spirodinaphthopyran, 3-benzyl-spiro-dinaphthopyran, 3-methylnaphtho-(6'-methoxybenzo)spiropyran and 3-propyl-spirodibenzopyran.

According to the invention, the color former can be contained in various nonvolatile organic solvents which are not particularly limited. At least one of organic solvents which are usually used for microcapsules for pressure sensitive manifold papers is usable. Examples of solvents generally useful are petroleum, kerosene, xylene, toluene and like mineral oils, and hydrogenated terphenyl, alkylnaphthalene, alkylated diphenylalkane, alkylated triphenylethane, alkylated diphenyl and like aromatic hydrocarbons. Aliphatic hydrocarbons, alcohols, ketones and esters are also usable as admixed with such solvents.

The process for preparing microcapsules is not particularly limited. Examples of useful processes are the coacervation process wherein gelatin, gum arabic or the like is used for forming the capsule wall, and synthetic processes for forming capsule walls from urea-formaldehyde, isocyanate, nylon, etc. Further in order to improve the storage stability, fluidity and adhesion of the capsule composition according to conventional technique, the composition may contain starch, casein, polyvinyl alcohol, acrylamide synthetic high polymers and like adhesives, pulp powder, raw starch powder and like stilt materials, dyes and other additives. The composition can be applied to a substrate to form a color former layer thereon by coating with use of an air knife coater, roll coater, gravure coater, blade coater or the like, or by various printing methods.

The color acceptor layer to be used in combination with the color former layer in the pressure sensitive manifold paper of this invention is prepared from a composition consisting chiefly of a color acceptor and an adhesive. Examples of useful color acceptors are acid clay, activated clay, attapulgite, zeolite, bentonite and like clay minerals, tannic acid, gallic acid and like organic acids, phenolic resin, salicylic acid derivatives, etc. When desired, the composition may further contain inorganic pigments, such as zinc oxide, titanium oxide, magnesium oxide and calcium carbonate, and other auxiliary agents.

The invention will be described in greater detail with reference to the following Examples and Comparison Examples. However, the invention is not limited to such examples. The parts and percentages in the examples are all by weight unless otherwise specified.

EXAMPLE 1

Four parts of 2-(N-methylanilino)-6-(N-ethyl-p-toluidino)fluoran serving as a color former was dissolved in an organic solvent mixture of 80 parts of isopropylnaphthalene and 20 parts of kerosene. Four parts of 2,2'-methylenebis(6-tert-butyl-4-methylphenol) was then dissolved in the solution to obtain a color former oil. A 20 part quantity of gelatin obtained by treating pigskin with an acid and 20 parts of gum arabic were dissolved in 500 parts of water. The color former oil was admixed with the solution and dispersed therein to obtain an emulsified dispersion containing oily droplets 5μ in mean particle size. Water (800 parts) having a temperature of 60° C. was added to the dispersion with stirring, and the pH of the mixture was then adjusted to 4.2 with 10% acetic acid to effect coacervation. With continued stirring, the mixture was cooled to gel the resulting coacervate. After the temperature of the mixture dropped to 10° C., 12 parts of 37% formalin solution was added thereto, and the resulting mixture was adjusted to a pH of 9 with a 5% aqueous solution of caustic soda. The mixture was further continuously stirred for 4 hours to prepare a dispersion of microcapsules.

A pulp powder (30 parts) and 15 parts, calculated as solids, of a starch solution were added to the capsule dispersion per 100 parts of the capsules calculated as solids. Water was further added to the mixture to obtain a color former composition having a solids concentration of 15%.

The composition was applied to paper in an amount by dry weight of 4 g/m$^2$ and then dried to obtain top sheets.

EXAMPLE 2

In the same manner as in Example 1, a top sheet was prepared except that further 4 parts of tris(nonylphenyl)phosphite was added to the color former oil based on 100 parts of the solvent mixture.

EXAMPLE 3

In the same manner as in Example 2, a top sheet was prepared except that further 0.5 part of nickel dibutyldithiocarbamate was added to the color former oil.

EXAMPLE 4

In the same manner as in Example 2, a top sheet was prepared except that 4 parts of dilauryl thiodipropionate was used in place of tris(nonylphenyl)phosphite.

COMPARISON EXAMPLE 1

In the same manner as in Example 1, a top sheet was prepared except that 2,2'-methylenebis(6-tert-butyl-4-methylphenol) was not used.

COMPARISON EXAMPLE 2

In the same manner as in Example 1, a top sheet was prepared except that 4 parts of 4,4'-isopropylidenebisphenol (bisphenol-A) was used in place of 2,2'-methylenebis(6-tert-butyl-4-methylphenol).

EXAMPLE 5

Into an organic solvent consisting of 100 parts of isopropylnaphthalene were dissolved 2 parts of 2-(3',5'-di-tert-butyl-2'-hydroxyphenyl)-5-chlorobenzotriazole and then, as a color former, 4 parts of 2-(N-methylanilino)-6-(N-ethyl-p-toluidino)fluoran. To the solution were added 2 parts of 2,2'-methylenebis(6-tert-butyl-4-methylphenol), 2 parts of dilauryl thiodipropionate and 0.5 part of nickel dibutyldithiocarbamate to obtain a color former oil.

In the same manner as in Example 1, a top sheet was prepared using the above color former oil.

EXAMPLE 6

In the same manner as in Example 5, a top sheet was prepared except that 2 parts of 2,6-di-tert-butyl-4-methylphenol was used in place of 2,2'-methylenebis(6-tert-butyl-4-methylphenol).

EXAMPLE 7

In the same manner as in Example 5, a top sheet was prepared except that 2 parts of tris(nonylphenyl)-phosphite was used in place of dilauryl thiodipropionate and 0.5 part of anthraquinone in place of nickel dibutyldithiocarbamate.

COMPARISON EXAMPLE 3

In the same manner as in Example 5, a top sheet was prepared except that 2,2'-methylenebis(6-tert-butyl-4-methylphenol), dilauryl thiodipropionate and nickel dibutyldithiocarbamate were not used.

EXAMPLE 8

Into an organic solvent mixture consisting of 90 parts of hydrogenated terphenyl and 10 parts of chlorinated paraffin were dissolved, as color formers, 3 parts of crystal violet lactone and 1 part of benzoyl-leucomethyleneblue. To the solution were added 2 parts of 2,2'-methylenebis(6-tert-butyl-4-methylphenol) and 2 parts of tris(nonylphenyl)phosphite to prepare a color former oil. In the same manner as in Example 1, a top sheet was prepared using the above color former oil.

EXAMPLE 9

In the same manner as in Example 8, a top sheet was prepared except that 2 parts of 4-tert-butylcatechol was used in place of 2,2'-methylenebis(6-tert-butyl-4-methylphenol) and further 0.5 part of $\beta$-naphthoquinone was used.

COMPARISON EXAMPLE 4

In the same manner as in Example 8, a top sheet was prepared except that 2,2'-methylenebis(6-tert-butyl-4-methylphenol) and tris(nonyophenyl)phosphite were not used.

EXAMPLE 10

In the same manner as in Example 1, a top sheet was prepared except that 4 parts of n-dodecyl mercaptan was used in place of 2,2'-methylenebis(6-tert-butyl-4-methylphenol).

EXAMPLE 11

In the same manner as in Example 10, a top sheet was prepared except that 4 parts of 4-tert-butylthiophenol was used in place of n-dodecyl mercaptan.

EXAMPLE 12

In the same manner as in Example 10, a top sheet was prepared except that 4 parts of 2-mercaptobenzothiazole was used in place of n-dodecyl mercaptan.

EXAMPLE 13

In the same manner as in Example 10, a top sheet was prepared except that further 4 parts of tris(nonylphenyl)phosphite was added to the color former oil based on 100 parts of the solvent mixture.

EXAMPLE 14

In the same manner as in Example 13, a top sheet was prepared except that 4 parts of dilauryl thiodipropionate was used in place of tris(nonylphenyl)phosphite.

EXAMPLE 15

In the same manner as in Example 13, a top sheet was prepared except that further 0.5 part of nickel dibutyldithiocarbamate was added to the color former oil.

EXAMPLE 16

In the same manner as in Example 2, a top sheet was prepared except that 4 parts of 4,4'-thiobis(6-tert-butyl-3-methylphenol) was used in place of 2,2'-methylenebis(6-tert-butyl-4-methylphenol).

EXAMPLE 17

In the same manner as in Example 4, a top sheet was prepared except that 4 parts of 4,4'-butylidenebis(6-tert-butyl-3-methylphenol) and 0.5 part of nickel dibutyldithiocarbamate were used in place of 2,2'-methylenebis(6-tert-butyl-4-methylphenol).

EXAMPLE 18

In the same manner as in Example 5, a top sheet was prepared except that 2 parts of 1,1,3-tris(5-tert-butyl-4-hydroxy-2-methylphenyl)butane was used in place of 2,2'-methylenebis(6-tert-butyl-4-methylphenol).

EXAMPLE 19

In the same manner as in Example 10, a top sheet was prepared except that 4 parts of 1,10-decanedithiol was used in place of n-dodecyl mercaptan.

EXAMPLE 20

In the same manner as in Example 13, a top sheet was prepared except that 4 parts of toluene-3,4-dithiol was used in place of n-dodecyl mercaptan.

EXAMPLE 21

In the same manner as in Example 1, a top sheet was prepared except that the following compounds were added to the color former oil based on 100 parts of the solvent mixture.

4,4'-Butylidenebis(6-tert-butyl-3-methylphenol): 2 parts
Dithiohydroquinone: 2 parts
Tris(nonylphenyl)phosphite: 2 parts
Anthraquinone: 0.5 part

PREPARATION OF BOTTOM SHEETS

Activated clay (100 parts), 10 parts of 20% caustic soda, 20 parts of styrene-butadiene latex (calculated as solids) and 300 parts of water were mixed together to prepare a color acceptor composition, which was then applied to paper in an amount by dry weight of 6 g/m$^2$ and dried to obtain bottom sheets.

EVALUATION TESTS (I) CB coloration

The top sheets obtained in Examples and Comparison Examples were exposed to sunlight for 30 minutes or 60 minutes, each directly over the color former layer, and were thereafter checked with the unaided eye for color change in the color former layer. Table 1 gives the result, in which ◎ shows CB coloration is extremely little, ○ CB coloration practically no problem and Δ CB coloration marked and practically problem.

(II) Color change of exposed CB print

The top sheet exposed to sunlight in the above test was placed over an bottom sheet, with the color former and acceptor layers opposed face-to-face, and the sheets were subjected to pressure of 600 kg/cm$^2$ for color reaction. The spectral absorption curve of the colored acceptor layer was determined by a self-recording spectrophotometer, Model UVIDEC-505, product of Nippon Bunko Co., Ltd., Japan. An unexposed top sheet and a bottom sheet were similarly tested in combination to obtain the spectral absorption curve of the colored layer. One or two absorption maximum wavelengths $\lambda_1$ and $\lambda_2$ were read from each of the curves. Light resistance value A was calculated from the following equation with use of the absorption densities at the maximum wavelengths. Table 1 shows the result.

$$\text{Light resistance value } A\ (LRV\text{-}A) = \frac{\text{Absorption density after exposure}}{\text{Absorption density before exposure}} \times 100$$

(III) Light resistance of print

Each of top sheets obtained in Examples and Comparison Examples was placed over a bottom sheet, and the assembly was subjected to pressure of 600 kg/cm$^2$ for color reaction. The colored bottom sheet was allowed to stand in the dark for one hour, and the spectral absorption curve was thereafter determined. Subsequently the colored surface was exposed to sunlight for one or 3 hours, and the spectral absorption curve of the resulting surface was determined. One or two absorption maximum wavelengths $\lambda_3$ and $\lambda_4$ were read from each of the curves.

The light resistance value B (LRV-B) of the print was calculated in the same manner as above, with the result also given in Table 1.

COMPARISON EXAMPLE 5

In the same manner as in the above, evaluation tests were conducted with use of a top sheet of Comparison Example 1 and a bottom sheet prepared in the same manner as in the above bottom-sheet preparation method except that further 8 parts of 2,2'-methylenebis(6-tert-butyl-4-methylphenol) was added to the color acceptor coating composition. The result was shown also in Table 1.

TABLE 1

| Ingredient (part) | | EX. 1 | EX.2 | EX. 3 | EX. 4 |
|---|---|---|---|---|---|
| 2,2'-methylenebis(6-t-butyl-4-methylphenol) | | 4 | 4 | 4 | 4 |
| 2,6-di-t-butyl-4-methylphenol | | — | — | — | — |
| 4-t-butylcatechol | | — | — | — | — |
| tris(nonylphenyl) phosphite | | — | 4 | 4 | — |
| dilauryl thiodipropionate | | — | — | — | 4 |
| anthraquinone | | — | — | — | — |
| β-naphthoquinone | | — | — | — | — |
| nickel dibutyldithiocarbamate | | — | — | 0.5 | — |
| bisphenol A | | — | — | — | — |
| CB coloration | | ○ | ◎ | ◎ | ○ |
| Color change of exposed CB print | | | | | |
| $\lambda_1$/LRV-A | (mμ/%) | | | | |
| exposed time (min.) | 0 | 565/100 | 565/100 | 565/100 | 565/100 |
| | 30 | 565/87.2 | 565/95.5 | 565/98.8 | 565/88.5 |
| | 60 | 530/66.3 | 560/80.3 | 560/82.9 | 540/70.5 |
| $\lambda_2$/LRV-A | (mμ/%) | | | | |
| exposed time (min.) | 0 | 470/100 | 470/100 | 470/100 | 470/100 |
| | 30 | 475/89.9 | 470/97.2 | 470/99.3 | 475/91.5 |
| | 60 | 490/68.4 | 475/83.6 | 475/86.5 | 485/72.4 |
| Light resistance of print | | | | | |
| $\lambda_3$LRV-B | (mμ/%) | | | | |
| exposed time (hour) | 0 | 565/100 | 565/100 | 565/100 | 565/100 |
| | 1 | 560/81.7 | 565/90.7 | 565/92.0 | 560/81.6 |
| | 3 | 555/64.6 | 560/78.5 | 560/80.1 | 555/63.8 |
| $\lambda_4$/LRV-B | (mμ/%) | | | | |
| exposed time (hour) | 0 | 470/100 | 470/100 | 470/100 | 470/100 |
| | 1 | 470/82.3 | 470/91.4 | 470/93.5 | 470/82.0 |
| | 3 | 475/66.1 | 475/80.2 | 475/82.7 | 475/65.5 |

| | | Com. EX. 1 | Com. EX. 2 | EX. 5 |
|---|---|---|---|---|
| 2,2'-methylenebis(6-t-butyl-4-methylphenol) | | — | — | 2 |
| 2,6-di-t-butyl-4-methylphenol | | — | — | — |
| 4-t-butylcatechol | | — | — | — |
| tris(nonylphenyl) phosphite | | — | — | — |
| dilauryl thiodipropionate | | — | — | 2 |
| anthraquinone | | — | — | — |
| β-naphthoquinone | | — | — | — |
| nickel dibutyldithiocarbamate | | — | — | 0.5 |
| bisphenol A | | — | 4 | — |
| CB coloration | | Δ | Δ | ◎ |
| Color change of exposed CB print | | | | |
| $\lambda_1$/LRV-A | (mμ/%) | | | |
| exposed time (min.) | 0 | 565/100 | 565/100 | 565/100 |
| | 30 | 565/79.2 | 565/78.8 | 565/94.2 |
| | 60 | 535/58.4 | 540/59.2 | 560/78.5 |
| $\lambda_2$/LRV-A | (mμ/%) | | | |
| exposed time (min.) | 0 | 470/100 | 470/100 | 470/100 |
| | 30 | 485/83.1 | 485/83.5 | 470/96.0 |
| | 60 | 490/61.4 | 490/60.8 | 475/80.1 |
| Light resistance of print | | | | |
| $\lambda_3$/LRV-B | (mμ/%) | | | |
| exposed time (hour) | 0 | 565/100 | 565/100 | 565/100 |
| | 1 | 550/72.5 | 550/70.6 | 565/90.4 |
| | 3 | 530/52.3 | 530/51.8 | 570/78.2 |
| $\lambda_4$/LRV-B | (mμ/%) | | | |
| exposed time (hour) | 0 | 470/100 | 470/100 | 470/100 |
| | 1 | 475/73.4 | 475/72.6 | 470/91.6 |
| | 3 | 475/55.2 | 475/54.5 | 475/80.2 |

| | EX. 6 | EX. 7 | Com. EX. 3 |
|---|---|---|---|
| 2,2'-methylenebis(6-t-butyl-4-methylphenol) | — | 2 | — |
| 2,6-di-t-butyl-4-methylphenol | 2 | — | — |
| 4-t-butylcatechol | — | — | — |
| tris(nonylphenyl) phosphite | — | 2 | — |
| dilauryl thio- | 2 | — | — |

TABLE 1-continued

| Ingredient (part) | | | | |
|---|---|---|---|---|
| dipropionate | | | | |
| anthraquinone | | — | 0.5 | — |
| β-naphthoquinone | | — | — | — |
| nickel dibutyldi-thiocarbamate | | 0.5 | — | — |
| bisphenol A | | — | — | — |
| CB coloration | | ◎ | ◎ | Δ |
| Color change of exposed CB print | | | | |
| $\lambda_1$/LRV-A | (mμ/%) | | | |
| exposed time (min.) | 0 | 565/100 | 565/100 | 565/100 |
| | 30 | 565/92.9 | 565/97.2 | 565/81.1 |
| | 60 | 560/74.3 | 560/81.8 | 535/63.3 |
| $\lambda_2$/LRV-A | (mμ/%) | | | |
| exposed time (min.) | 0 | 470/100 | 470/100 | 470/100 |
| | 30 | 475/95.0 | 470/99.0 | 480/84.6 |
| | 60 | 480/77.3 | 475/84.2 | 490/65.5 |
| Light resistance of print | | | | |
| $\lambda_3$/LRV-B | (mμ/%) | | | |
| exposed time (hour) | 0 | 565/100 | 565/100 | 565/100 |
| | 1 | 565/85.5 | 565/92.1 | 560/70.2 |
| | 3 | 570/71.3 | 565/81.1 | 550/51.6 |
| $\lambda_4$/LRV-B | (mμ/%) | | | |
| exposed time (hour) | 0 | 470/100 | 470/100 | 470/100 |
| | 1 | 470/86.2 | 470/92.8 | 475/72.2 |
| | 3 | 475/73.6 | 475/82.4 | 480/53.0 |

| | EX. 8 | EX. 9 | Com. EX. 4 |
|---|---|---|---|
| 2,2'-methylenebis(6-t-butyl-4-methylphenol) | 2 | — | — |
| 2,6-di-t-butyl-4-methylphenol | — | — | — |
| 4-t-butylcatechol | — | 2 | — |
| tris(nonylphenyl) phosphite | 2 | 2 | — |
| dilauryl thio-dipropionate | — | — | — |
| anthraquinone | — | — | — |
| β-naphthoquinone | — | 0.5 | — |
| nickel dibutyldi-thiocarbamate | — | — | — |
| bisphenol A | — | — | — |
| CB coloration | ○ | ○ | ○ |
| Color change of exposed CB print | | | |
| $\lambda_1$/LRV-A (mμ/%) | | | |
| exposed time (min.) 0 | 610/100 | 610/100 | 610/100 |
| 30 | 610/86.5 | 605/84.6 | 605/66.5 |
| 60 | 600/65.1 | 600/62.5 | 580/39.6 |
| Light resistance of print | | | |
| $\lambda_3$/LRV-B (mμ/%) | | | |
| exposed time (hour) 0 | 610/100 | 610/100 | 610/100 |
| 1 | 605/93.5 | 605/89.2 | 600/74.3 |
| 3 | 600/72.7 | 600/64.9 | 570/42.8 |

| | EX. 10 | EX. 11 | EX. 12 | EX. 13 |
|---|---|---|---|---|
| n-dodecyl mercaptan | 4 | — | — | 4 |
| 4-t-butylthiophenol | — | 4 | — | — |
| 2-mercaptobenzo-thiazole | — | — | 4 | — |
| tris(nonylphenyl) phosphite | — | — | — | 4 |
| dilauryl thio-dipropionate | — | — | — | — |
| nickel dibutyldi-thiocarbamate | — | — | — | — |
| CB coloration | ○ | ○ | ○ | ◎ |
| Color change of exposed CB print | | | | |
| $\lambda_1$/LRV-A (mμ/%) | | | | |
| exposed time (min.) 0 | 565/100 | 565/100 | 565/100 | 565/100 |
| 30 | 565/92.8 | 565/90.9 | 565/92.5 | 565/95.4 |
| 60 | 540/78.4 | 540/79.5 | 540/75.2 | 540/80.4 |
| $\lambda_2$/LRV-A (mμ/%) | | | | |
| exposed time 0 | 470/100 | 470/100 | 470/100 | 470/100 |

TABLE 1-continued

| Ingredient (part) | | | | | |
|---|---|---|---|---|---|
| (min.) | 30 | 470/94.1 | 470/94.8 | 470/92.7 | 470/95.1 |
| | 60 | 480/80.0 | 480/80.5 | 480/78.0 | 480/82.6 |
| Light resistance of print | | | | | |
| $\lambda_3$/LRV-B | (mμ/%) | | | | |
| exposed time | 0 | 565/100 | 565/100 | 565/100 | 565/100 |
| (hour) | 1 | 560/82.4 | 565/81.5 | 565/82.9 | 560/88.0 |
| | 3 | 555/72.6 | 550/70.6 | 555/70.5 | 555/79.5 |
| $\lambda_4$/LRV-B | (mμ/%) | | | | |
| exposed time | 0 | 470/100 | 470/100 | 470/100 | 470/100 |
| (hour) | 1 | 470/84.8 | 470/83.6 | 470/85.2 | 470/89.3 |
| | 3 | 475/74.9 | 475/70.8 | 475/71.1 | 475/80.4 |

| | EX. 14 | EX. 15 | Com. EX. 5 |
|---|---|---|---|
| n-dodecyl mercaptan | 4 | 4 | — |
| 4-t-butylthiophenol | — | — | — |
| 2-mercaptobenzo-thiazole | — | — | — |
| tris(nonylphenyl) phosphite | — | 4 | — |
| dilauryl thio-dipropionate | 4 | — | — |
| nickel dibutyldi-thiocarbamate | — | 0.5 | — |
| CB coloration | ◎ | ◎ | Δ |
| Color change of exposed CB print | | | |
| $\lambda_1$/LRV-A (mμ/%) | | | |
| exposed time (min.) 0 | 565/100 | 565/100 | 565/100 |
| 30 | 565/94.6 | 565/99.5 | 565/79.2 |
| 60 | 540/81.2 | 540/87.5 | 535/58.4 |
| $\lambda_2$/LRV-A (mμ/%) | | | |
| exposed time (min.) 0 | 470/100 | 470/100 | 470/100 |
| 30 | 470/96.3 | 470/97.0 | 485/83.1 |
| 60 | 480/83.5 | 480/85.0 | 490/61.4 |
| Light resistance of print | | | |
| $\lambda_3$/LRV-B (mμ/%) | | | |
| exposed time (hour) 0 | 565/100 | 565/100 | 565/100 |
| 1 | 560/86.6 | 565/91.8 | 550/73.5 |
| 3 | 555/77.6 | 560/81.5 | 530/52.8 |
| $\lambda_4$/LRV-B (mμ/%) | | | |
| exposed time (hour) 0 | 470/100 | 470/100 | 470/100 |
| 1 | 470/88.1 | 470/92.5 | 475/74.2 |
| 3 | 475/78.7 | 475/83.7 | 475/56.3 |

| | EX. 16 | EX. 17 | EX. 18 |
|---|---|---|---|
| 4,4'-thiobis(6-t-butyl-3-methylphenol) | 4 | — | — |
| 4,4'-butylidenebis(6-t-butyl-3-methylphenol) | — | 4 | — |
| 1,1,3-tris(5-t-butyl-4-hydroxy-2-methylphenyl) butane | — | — | 2 |
| 1,10-decanedithiol | — | — | — |
| toluene-3,4-dithiol | — | — | — |
| dithiohydroquinone | — | — | — |
| tris(nonylphenyl)phosphite | 4 | — | — |
| dilauryl thiodipropionate | — | 4 | 2 |
| anthraquinone | — | — | — |
| nickel dibutyldithio-carbamate | — | 0.5 | 0.5 |
| CB coloration | ◎ | ◎ | ○ |
| Color change of exposed CB print | | | |
| $\lambda_1$/LRV-A (mμ/%) | | | |
| exposed time (min.) 0 | 565/100 | 565/100 | 565/100 |
| 30 | 565/94.3 | 565/96.2 | 565/85.9 |
| 60 | 560/77.6 | 560/79.6 | 560/71.0 |
| $\lambda_2$/LRV-A (mμ/%) | | | |
| exposed time (min.) 0 | 470/100 | 470/100 | 470/100 |
| 30 | 470/95.6 | 470/95.8 | 475/88.4 |
| 60 | 480/79.8 | 475/80.3 | 485/72.7 |
| Light resistance of print | | | |
| $\lambda_3$/LRV-B (mμ/%) | | | |
| exposed time 0 | 565/100 | 565/100 | 565/100 |

TABLE 1-continued

| Ingredient (part) | | | | |
|---|---|---|---|---|
| (hour) | 1 | 565/88.5 | 565/91.3 | 560/81.3 |
| | 3 | 560/72.3 | 560/75.1 | 555/64.6 |
| $\lambda_4$/LRV-B | (mμ/%) | | | |
| exposed time | 0 | 470/100 | 470/100 | 470/100 |
| (hour) | 1 | 470/90.5 | 470/92.3 | 470/83.3 |
| | 3 | 475/80.7 | 470/81.6 | 475/67.5 |
| | | EX. 19 | EX. 20 | EX. 21 |
| 4,4'-thiobis(6-t-butyl-3-methylphenol) | | — | — | — |
| 4,4'-butylidenebis(6-t-butyl-3-methylphenol) | | — | — | 2 |
| 1,1,3-tris(5-t-butyl-4-hydroxy-2-methylphenyl) butane | | — | — | — |
| 1,10-decanedithiol | | 4 | — | — |
| toluene-3,4-dithiol | | — | 4 | — |
| dithiohydroquinone | | — | — | 2 |
| tris(nonylphenyl)phosphite | | — | 4 | 2 |
| dilauryl thiodipropionate | | — | — | — |
| anthraquinone | | — | — | 0.5 |
| nickel dibutyldithiocarbamate | | — | — | — |
| CB coloration | | ○ | ◎ | ◎ |
| Color change of exposed CB print | | | | |
| $\lambda_1$/LRV-A | (mμ/%) | | | |
| exposed time | 0 | 565/100 | 565/100 | 565/100 |
| (min.) | 30 | 565/87.5 | 565/93.9 | 565/96.5 |
| | 60 | 540/73.2 | 545/80.2 | 545/84.5 |
| $\lambda_2$/LRV-A | (mμ/%) | | | |
| exposed time | 0 | 470/100 | 470/100 | 470/100 |
| (min.) | 30 | 470/90.1 | 470/95.0 | 470/96.2 |
| | 60 | 480/77.6 | 480/83.6 | 480/83.8 |
| Light resistance of print | | | | |
| $\lambda_3$/LRV-B | (mμ/%) | | | |
| exposed time | 0 | 565/100 | 565/100 | 565/100 |
| (hour) | 1 | 560/82.5 | 560/88.0 | 560/91.0 |
| | 3 | 555/67.6 | 560/78.8 | 560/79.0 |
| $\lambda_4$/LRV-B | (mμ/%) | | | |
| exposed time | 0 | 470/100 | 470/100 | 470/100 |
| (hour) | 1 | 470/85.0 | 470/90.2 | 470/91.8 |
| | 3 | 475/70.3 | 475/82.0 | 475/81.1 |

Table 1 shows that the pressure sensitive manifold paper obtained in each of Examples of the invention is less susceptible to CB coloration despite the exposure to sunlight, gives an exposed CB print of good color quality because the sunlight exposure entails only a small difference in absorption maximum wavelength and a lesser reduction in absorption density, and affords a colorfast print. Thus the manifold paper has greatly improved and well balanced light resistance in respect of these three properties.

We claim:

1. A pressure sensitive manifold paper having microcapsules incorporated therein, the microcapsules enclosing a nonvolatile organic solvent and a color former in the organic solvent, the organic solvent further comprising at least one of an alkylphenol compound and a mercaptan, in an amount of 0.2 to 10 parts by weight per 100 parts by weight of the organic solvent, and at least one of phosphorous acid triesters and thioesters, the mercaptan being in the form of a solid at room temperature or having a boiling point of at least 150° C., wherein the alkylphenol is selected from the group consisting of phenols having a substituent selected from the group consisting of alkyl, cycloalkyl, alkylene and hydroxyl substituents at least at one of the 2- and 6-positions, and derivatives thereof, the mercaptan is selected from the group consisting of alkyl monomercaptans, alkyl dimercaptans, aromatic monomercaptans, aromatic dimercaptans, and derivatives thereof, and the phosphorous acid triesters and thioesters are selected from the group represented by the formula (8) and formula (9):

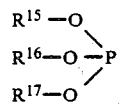

(8)

wherein $R^{15}$, $R^{16}$ and $R^{17}$ are $C_{4-20}$ alkyl, phenyl or $C_{7-20}$ alkylphenol,

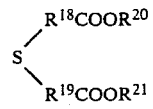

(9)

wherein $R^{18}$ and $R^{19}$ are $C_{1-6}$ alkylene, and $R^{20}$ and $R^{21}$ are $C_{8-22}$ alkyl.

2. A pressure sensitive manifold paper as defined in claim 1 wherein the alkylphenol compounds are monophenols represented by the formula

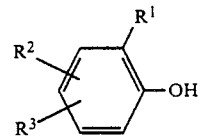

(1)

wherein $R^1$ is $C_{1-5}$ alkyl, $C_{5-7}$ cycloalkyl, hydroxyl or $(R^4)_2NR^5$— in which $R^4$ is hydrogen or $C_{1-5}$ alkyl, and $R^5$ is $C_{1-3}$ alkylene, and $R^2$ and $R^3$ are each hydrogen, $C_{1-5}$ alkyl, $C_{5-7}$ cycloalkyl, $C_{1-3}$ hydroxyalkyl, $C_{1-3}$ alkoxyl, hydroxyl or $(R^4)_2NR^5$— in which $R^4$ and $R^5$ are as defined above.

3. A pressure sensitive manifold paper as defined in claim 1 wherein the alkylphenol compounds are diphenols represented by the formula

P—A—P (2)

wherein A is $-(CH_2)_a-$,

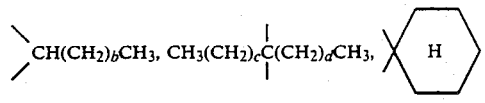

or —S— in which a is 0 or 1, b is 0 or an integer of 1 to 5, and c and d are each 0 or an integer of 1 or 2, and P is

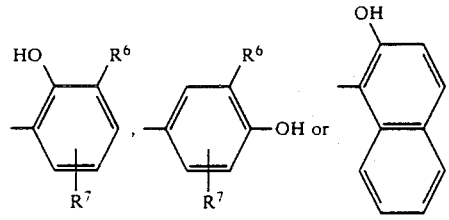

in which $R^6$ is $C_{1-5}$ alkyl, $C_{5-7}$ cycloalkyl, hydroxyl or $(R^4)_2NR^5$—, and $R^7$ is hydrogen, $C_{1-5}$ alkyl, $C_{5-7}$ cycloalkyl, $C_{1-3}$ alkoxyl, hydroxyl or $(R^4)_2NR^5$—, $R^4$ and $R^5$ being as defined above.

4. A pressure sensitive manifold paper as defined in claim 1 wherein the alkylphenol compounds are triphenols represented by the formula

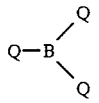

(3)

wherein B is

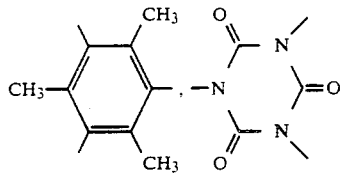

or trivalent $C_{1-5}$ aliphatic hydrocarbon residue, and Q is

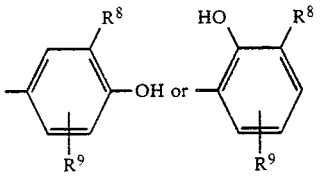

in which $R^8$ is $C_{1-5}$ alkyl and $R^9$ is hydrogen, $C_{1-5}$ alkyl or hydroxyl.

5. A pressure sensitive manifold paper as defined in claim 1 wherein the alkylphenol compound is selected from the group consisting of 2,6-di-tert-butyl-4-methylphenol, 4-tert-butylcathechol, 2,2'-methylene-bis(6-tert-butyl-4-ethylphenol), 4,4'-butylidenebis(6-tert-butyl-3-methylphenol) and 4,4'-thiobis(6-tert-butyl-3-methylphenol).

6. A pressure sensitive manifold paper as defined in claim 1 wherein the mercaptan compounds are alkyl monomercaptans and alkyl dimercaptans represented by the formula $$R^{10}(SH)_e \quad (4)$$

wherein $R^{10}$ is $C_{10-18}$ alkyl or $C_{10-18}$ alkylene, e is 1 or 2.

7. A pressure sensitive manifold paper as defined in claim 1 wherein the phosphorous acid triester is selected from the group consisting of tris-(nonylphenyl)-phosphite, di(nonylphenyl)-(dinonylphenyl)-phosphite, diphenyl-isooctylphosphite, diphenyl-isodecyl-phosphite, triisooctylphosphite and triisodecylphosphite.

8. A pressure sensitive manifold paper as defined in claim 1 wherein the thioether is selected from the group consisting of dilauryl thiodipropionate, dimyristyl thiodipropionate, dicetyl thiodipropionate, ditridecyl thiodipropionate, lauryl stearyl thiodipropionate, distearyl-β,β'-thiodibutyrate, 3-carbolauryloxyethyl-4'-carbolauryloxypropyl thioether and 4-carbostearyloxy propyl-5'-carbolauryloxybutyl thioether.

9. A pressure sensitive manifold paper as defined in claim 1 wherein the at least one of phosphorous acid triester and thioether is added in an amount of 0.2 to 8 parts by weight per 100 parts by weight of the organic solvent.

10. A pressure sensitive manifold paper as defined in claim 1 wherein at least one compound selected from the group consisting of p-benzoquinone, α-naphthoquinone, β-naphthoquinone, anthraquinone, nickel dibutyldithiocarbamate, α-tocopherol and 1,1-diphenyl-2-picrylhydrazyl is incorporated in the organic solvent as a third component.

11. A pressure sensitive manifold paper as defined in claim 10 wherein the third component is added in an amount of 0.1 to 3 parts by weight per 100 parts by weight of the organic solvent.

12. A pressure sensitive manifold paper as defined in claim 1 wherein a xanthene-based dye is used as the color former.

13. A pressure sensitive manifold paper as defined in claim 1 wherein the mercaptan compounds are selected from the group consisting of aromatic monomercaptains and aromatic dimercaptans represented by the formula:

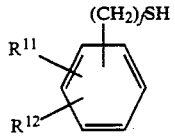

(5)

wherein $R^{11}$ and $R^{12}$ are hydrogen, mercapto, or $C_{1-18}$ alkyl, and f is 0 or 1; and mercaptan compounds represented by the formulae:

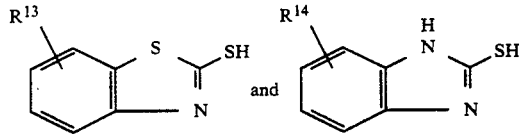

(6) (7)

wherein $R^{13}$ and $R^{14}$ are hydrogen or $C_{1-3}$ alkyl.

14. A pressure sensitive manifold paper as defined in claim 1, wherein the alkylphenol compound is selected from the group consisting of octadecyl-3-(3,5-di-tert-butyl-4-hydroxyphenyl)propionate, 6-(3,5-di-tert-butyl-4-hydroxyanilino)-2,4-bis(n-octylthio)-1,3,5-triazine, (3,5-di-tert-butyl-4-hydroxybenzyl)ethyl phosphate, (3,5-di-tert-butyl-4-hydroxybenzyl)octadecyl phosphate, tetrakis-(methylene-3-(3',5'-di-tert-butyl-4'-hydroxyphenyl)propionate)methane, 2,2'-thiodiethylbis(3-(3',5'-di-tert-butyl-4'-hydroxyphenyl)propionate), N,N'-hexamethylenebis(3,5-di-tert-butyl-4-hydroxyhydrocinnamamide) and 1,6-hexane-diolbis-3-(3',5'-di-tert-butyl-4'-hydroxyphenyl)propionate.

* * * * *